US007337563B2

(12) United States Patent
Miyazaki

(10) Patent No.: US 7,337,563 B2
(45) Date of Patent: Mar. 4, 2008

(54) WORK VEHICLE HAVING IMPROVED MOUNTING STRUCTURE OF CONTROL VALVE UNIT

(75) Inventor: Eiji Miyazaki, Sakai (JP)

(73) Assignee: Kubota Corporation, Osaka (JP)

( * ) Notice: Subject to any disclaimer, the term of this patent is extended or adjusted under 35 U.S.C. 154(b) by 302 days.

(21) Appl. No.: 11/069,580

(22) Filed: Mar. 1, 2005

(65) Prior Publication Data

US 2005/0210716 A1 Sep. 29, 2005

(30) Foreign Application Priority Data

Mar. 25, 2004 (JP) ..... 2004-090094

(51) Int. Cl.
*E01H 5/04* (2006.01)
*E02F 5/02* (2006.01)

(52) U.S. Cl. ..... 37/234; 60/421; 60/484; 414/686; 414/699

(58) Field of Classification Search ..... 37/423, 37/234, 348, 902; 60/421, 484; 414/699, 414/686

See application file for complete search history.

(56) References Cited

U.S. PATENT DOCUMENTS 3,047,171 A * 7/1962 Long ..... 414/694
4,397,603 A * 8/1983 Kraske et al. ..... 414/695.5
6,637,136 B2 10/2003 Aoki et al.

FOREIGN PATENT DOCUMENTS

JP 2003-129513 5/2003

* cited by examiner

*Primary Examiner*—Thomas B. Will
*Assistant Examiner*—Mai T Nguyen
(74) *Attorney, Agent, or Firm*—The Webb Law Firm

(57) ABSTRACT

A work vehicle includes a traveling vehicle, a backhoe having a base frame detachably connected to a rear portion of the traveling vehicle and an excavator detachably attached to a rear portion of the base frame. The base frame includes a pair of upper and lower base plates and a partitioning wall disposed at a fore-and-aft intermediate portion of the base plates for connecting the two base plates with each other and partitioning a space delimited between the plates relative to a fore and aft direction. A control box is mounted on the base frame. At least one swing cylinder is mounted to the base frame through the partitioning wall for pivoting the excavator. A control valve unit is attached to the partitioning wall downwardly of the control box for controlling a working fluid for driving the swing cylinder and the excavator. At least one swing hose is extended through the partitioning wall for hydraulically connecting the control valve unit to the swing cylinder.

2 Claims, 5 Drawing Sheets

WORK VEHICLE HAVING IMPROVED MOUNTING STRUCTURE OF CONTROL VALVE UNIT

BACKGROUND OF THE INVENTION

1. Field of the Invention

The present invention relates to a work vehicle, more particularly to a work vehicle comprising a traveling vehicle such as a tractor, and at least a rear implement such as a backhoe mounted to the rear portion of the traveling vehicle body.

2. Description of the Related Art

As an example of the work vehicle of the above type, there is known a vehicle referred to as "TLB" (a tractor with a front loader and a backhoe) comprising a tractor, a front loader mounted to a front portion of the tractor and a backhoe mounted to a rear portion of the tractor. (See JP-A-2003-129513, for example.)

The backhoe of the work vehicle includes an excavator having a swing bracket, a boom, an arm, a bucket, etc., which are driven by e.g. a hydraulic unit comprising hydraulic cylinders. A control valve unit for controlling this hydraulic unit is disposed inside a control box of a controller mounted on a base frame of the backhoe. Further, a hydraulic pump for feeding a working fluid to the control valve unit and a working fluid tank holding the working fluid therein are mounted on the tractor, and a swing cylinder for pivoting the swing bracket is disposed within the base frame of the backhoe.

With the conventional work vehicle, since the control valve unit is disposed inside the control box mounted on the base frame of the backhoe, for e.g. connecting a hydraulic hose connected to the control valve unit to the swing cylinder, an operator needs to draw the hydraulic hose connected to the control valve unit out of the control box onto the base frame and then to extend the hose around the front portion of this base frame to eventually insert the hose into the base frame. Hence, the hydraulic hose needs to be manipulated for a significant distance in a rather meandering manner. In this way, the connecting operation of the piping (or hose) was very troublesome.

In view of the above-described state of the art, a primary object of the present invention is to provide a work vehicle which allows a swing hose connecting between a swing cylinder and a control valve unit to be formed shorter and arranged in a compact manner.

SUMMARY OF THE INVENTION

For accomplishing the above-noted object, according to the present invention, a work vehicle comprises:

a traveling vehicle;

a backhoe having a base frame detachably connected to a rear portion of the traveling vehicle and an excavator detachably attached to a rear portion of the base frame, said base frame including a pair of upper and lower base plates and a partitioning wall disposed at a fore-and-aft intermediate portion of the base plates for connecting the two base plates with each other and partitioning a space delimited between the plates relative to a fore and aft direction;

a control box mounted on the base frame;

at least one swing cylinder mounted to the base frame through the partitioning wall for pivoting the excavator;

a control valve unit attached to the partitioning wall downwardly of the control box for controlling a working fluid for driving the swing cylinder and the excavator; and at least one swing hose extended through the partitioning wall for hydraulically connecting the control valve unit to the swing cylinder.

With the above construction, since the control valve unit is disposed downwardly of the control box, the distance from this control valve unit to the swing cylinder also disposed downwardly of the control box can be shorter. Therefore, the swing hose for connecting between the swing cylinder and the control valve unit too can be formed shorter also and can be readily connected to the control valve unit and to the swing cylinder. Moreover, this swing hose can be arranged in a compact manner under the control box. In addition, as the partitioning wall is provided to the upper and lower base plates of the base frame, the control valve unit can be easily mounted within the base frame. And, this partitioning wall serves also to reinforce the base frame.

According to one preferred embodiment of the present invention, said swing cylinder includes a first swing cylinder and a second swing cylinder which are juxtaposed along the right/left direction, the first swing cylinder having a fluid feed/discharge port open toward the second swing cylinder, the second swing cylinder having a fluid feed/discharge port open toward the first swing cylinder.

With this construction, both ports are open inward along the right/left direction between the right and left swing cylinders. Therefore, if a hydraulic hose connecting the two swing cylinders and connecting members for connecting the ports and the hose are arranged between the right and left swing cylinders, no connecting members will be present on the outer sides in the right/left direction of the two swing cylinders. As a result, the right/left wise width of the base frame can be shorter and the piping to the respective ports can be formed shorter.

According to one embodiment for achieving the above-described advantageous effect, said each fluid feed/discharge port includes a first port on the side of a cylinder tube and a second port on the side of a cylinder rod;

a first hydraulic hose hydraulically connecting between the first port of the first swing cylinder and the second port of the second swing cylinder extends to intersect a second hydraulic hose hydraulically connecting between the first port of the second swing cylinder and the second port of the first swing cylinder; and said swing hose includes a first swing hose connected to the first port of the first swing cylinder and a second swing hose connected to the first port of the second swing cylinder.

Preferably, a pair of first hose connecting members projecting from said each first port are arranged in symmetry along the right/left direction between the first and second swing cylinders; and a pair of second hose connecting members projecting from said each second port are arranged in symmetry along the right/left direction between the first and second swing cylinders.

With the above constructions, by turning 180 degrees in reverse the first and second hose connecting members of one swing cylinder about a fore and aft axis toward the other swing cylinder, the respective connecting members can be used as connecting members for the other swing cylinder. That is, both the first and second hose connecting members can be attached to both the right and left swing cylinders. Therefore, by such shared use of the connecting members between the right and left swing cylinders, there is achieved a cost advantage.

According to a further embodiment, said each first hose connecting member includes a first projecting portion projecting from the first port, a bifurcating portion bifurcating upwardly and downwardly from the first projecting portion, and a first connecting portion provided at bifurcated leading ends of the bifurcating portion, said first connecting portion including two end portions bent in a same direction to each other for connecting each said hydraulic hose and each said swing hose respectively thereto; and said each second hose connecting member includes a second projecting portion projecting from the second port and a second connecting portion provided at a leading end of the second projecting portion for connecting each said hydraulic hose thereto.

Further and other features and advantages of the invention will become apparent upon reading following detailed description of the preferred embodiments thereof with reference to the accompanying drawings.

Incidentally, in the following description, the languages "fore and aft direction", "front face" and "rear face" are all used relative to the forward traveling direction of the vehicle body. On the other hand, the language "right/left direction" is used relative to the reverse traveling direction of the vehicle body (i.e. the direction which an operator seated at a backhoe operating seat faces). Further, the language "vertical direction" is used to denote the direction normal to the ground surface on which wheels of the vehicle are placed.

DESCRIPTION OF THE PREFERRED EMBODIMENTS

Preferred embodiments of the present invention will be described in details with reference to the accompanying drawings.

Figure 1:
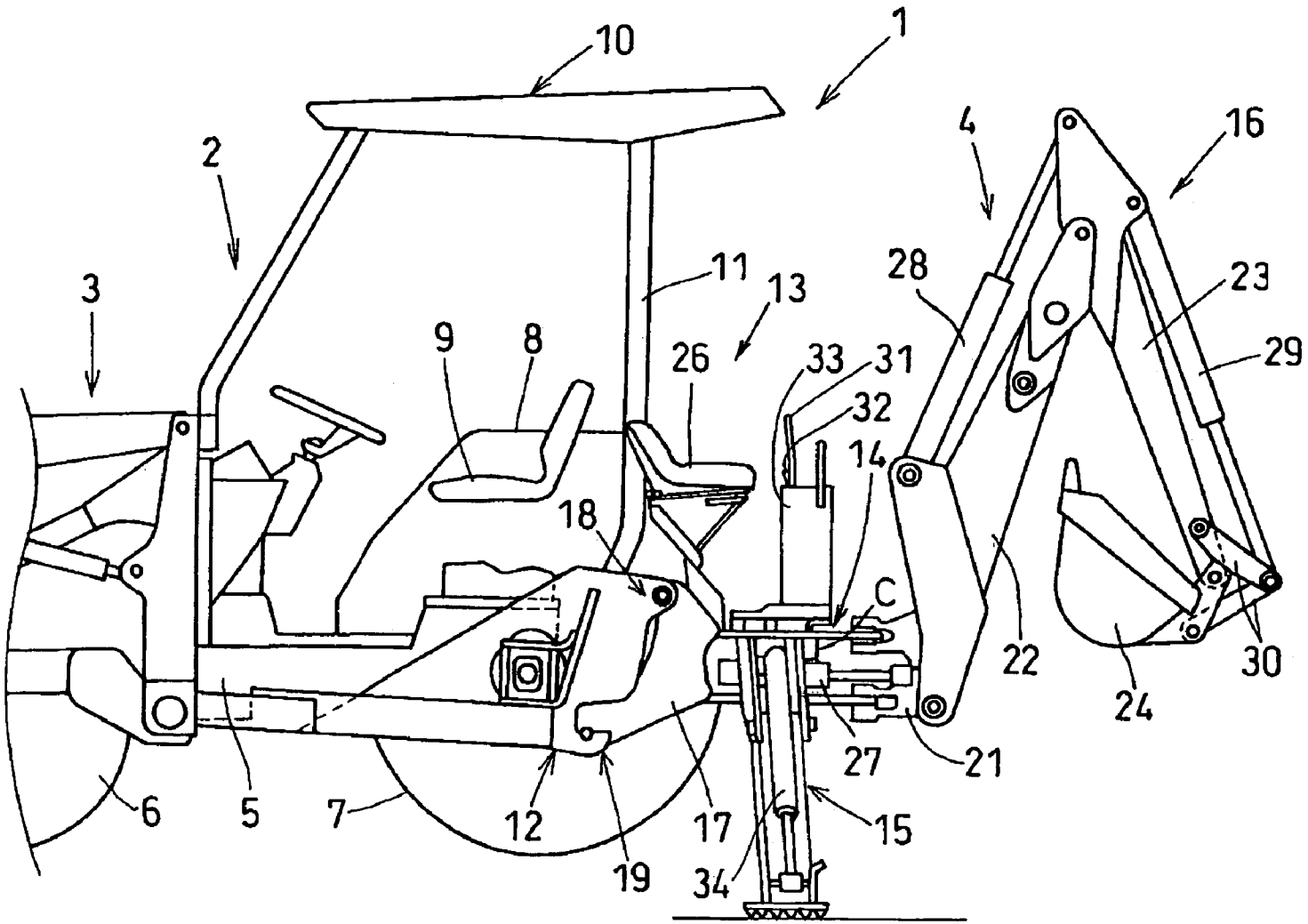
FIG. 1 is a schematic side view showing a work vehicle according to one preferred embodiment of the present invention.

Referring to FIG. 1, numeral 1 denotes a TLB (an example of work vehicle) including a tractor (an example of a traveling vehicle) 2, a front loader (an example of front implement) 3 mounted to a front portion of the tractor 2 and a backhoe (an example of rear implement) 4 mounted to a rear portion of the tractor (an example of work vehicle) 2.

The tractor 2 includes a vehicle body 5 having an engine, a flywheel housing, a clutch housing, a transmission case etc. and a pair of right and left front wheels 6 and a pair of right and left rear wheels 7 for allowing traveling of this tractor.

At a rear portion of the vehicle body 5, there is provided an operator's seat 9 on which an operator will be seated facing the forward direction between right and left rear wheel fenders 8. On the right and left sides of a canopy 10, rear support pillars 11 extend vertically.

On the right and left sides of the tractor vehicle body 5, there are provided a pair of right and left connecting frames 12 connected to each other, and to rear portions of these connecting frames 12, the backhoe 4 is detachably attached.

The backhoe 4 includes a base frame 14 detachably connected to the connecting frames 12. On the right and left sides of the base frame 14, there are provided outriggers 15 and an excavator (an example of implement) 16 is attached to the rear portion of the base frame 14 and a pair of right and left connected frames 17 are provided at the front portion of the same.

Each connected frame 17 is detachably attached to the connecting frame 12 via upper and lower connecting portions 18, 19.

The excavator 16 includes a swing bracket 21 pivotally connected to the rear portion of the base frame 14, with a front portion of the swing bracket 21 being pivotable in the right/left direction about a vertical axis, a vertically pivotable boom 22 having its base pivotally connected to the swing bracket 21 to be pivotable about a horizontal axis, a vertically pivotable arm 23 pivotally connected to the leading end of the boom 22 to be pivotable about a horizontal axis, and a bucket (an example of implement) 24 pivotally connected to the leading end of the arm 23 to be pivotable about a horizontal axis.

The swing bracket 21 is pivotally operated by means of a pair of right and left swing cylinders 27 provided between and across the base frame 14 and the swing bracket 21 (in the following discussion, each particular swing cylinder will be referred to as a right-side swing cylinder 27R or a left-side swing cylinder 27L, respectively). Further, the boom 22 is pivotally operated by a boom cylinder (not shown). The arm 23 is pivotally operated by an arm cylinder 28. Further, the bucket 24 is pivotally operated by a link mechanism 30 and a bucket cylinder 29. Each outrigger 15 is vertically pivotable by means of an outrigger cylinder 34 provided between the base frame 14 and the outrigger 15. These components, i.e. the swing cylinder 27, the boom cylinder, the arm cylinder 28, the bucket cylinder 29, the outrigger cylinders 34 comprise hydraulic cylinders.

For this backhoe 4, there is provided a dedicated backhoe operating seat 26 on which the operator is to be seated for operating the excavator 16. The backhoe operating seat 26 is provided rearwardly of the operator's seat 9 of the tractor 2 and forwardly of a control box 33 of the backhoe 4.

As the operator is seated facing the rear side when operating the excavator 16, the backhoe operating seat 26 is disposed with a rearward orientation to allow the operator to be seated thereon facing rearward.

Figure 2:
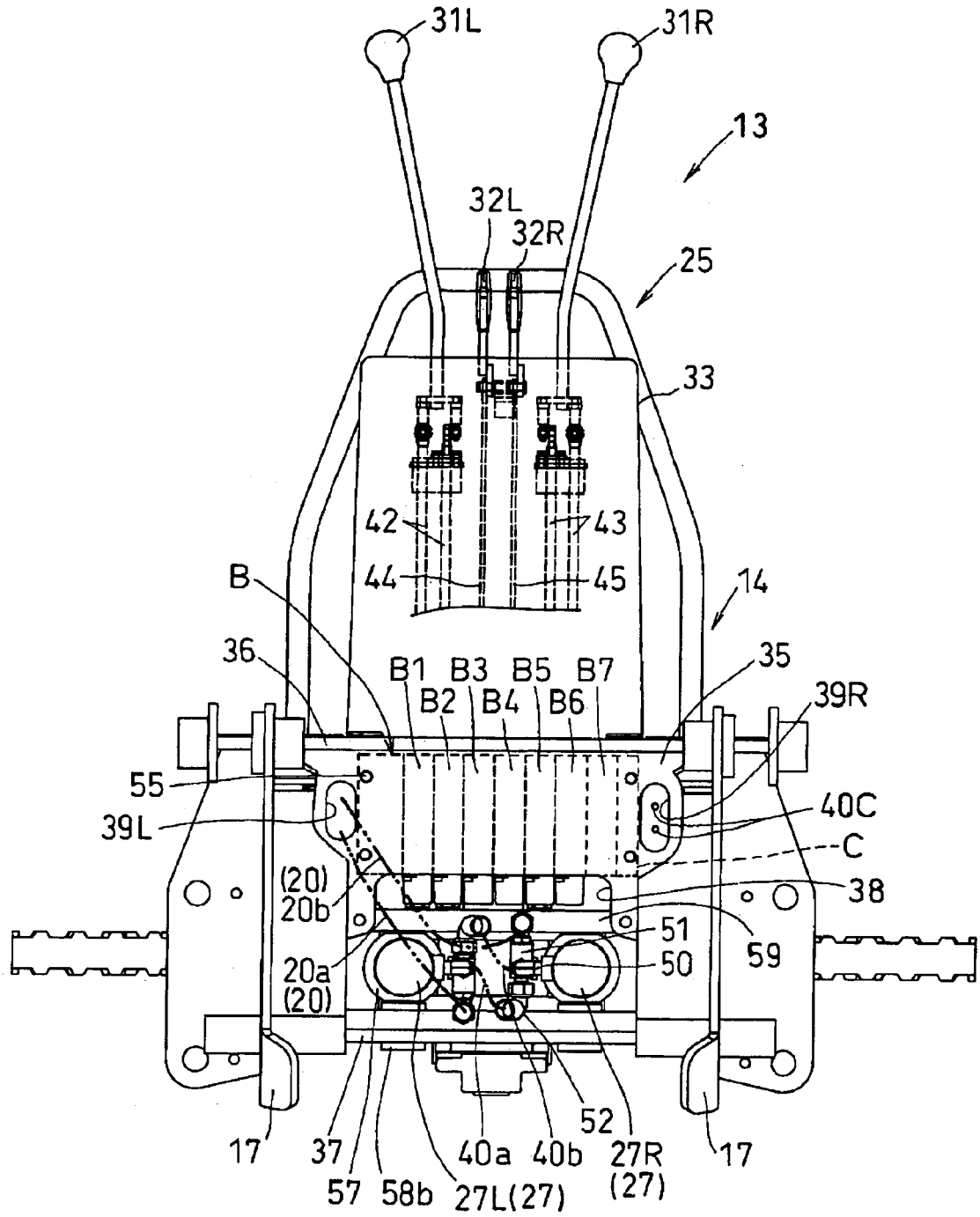
FIG. 2 is a front view of a backhoe operating section in FIG. 1.
Figure 3:
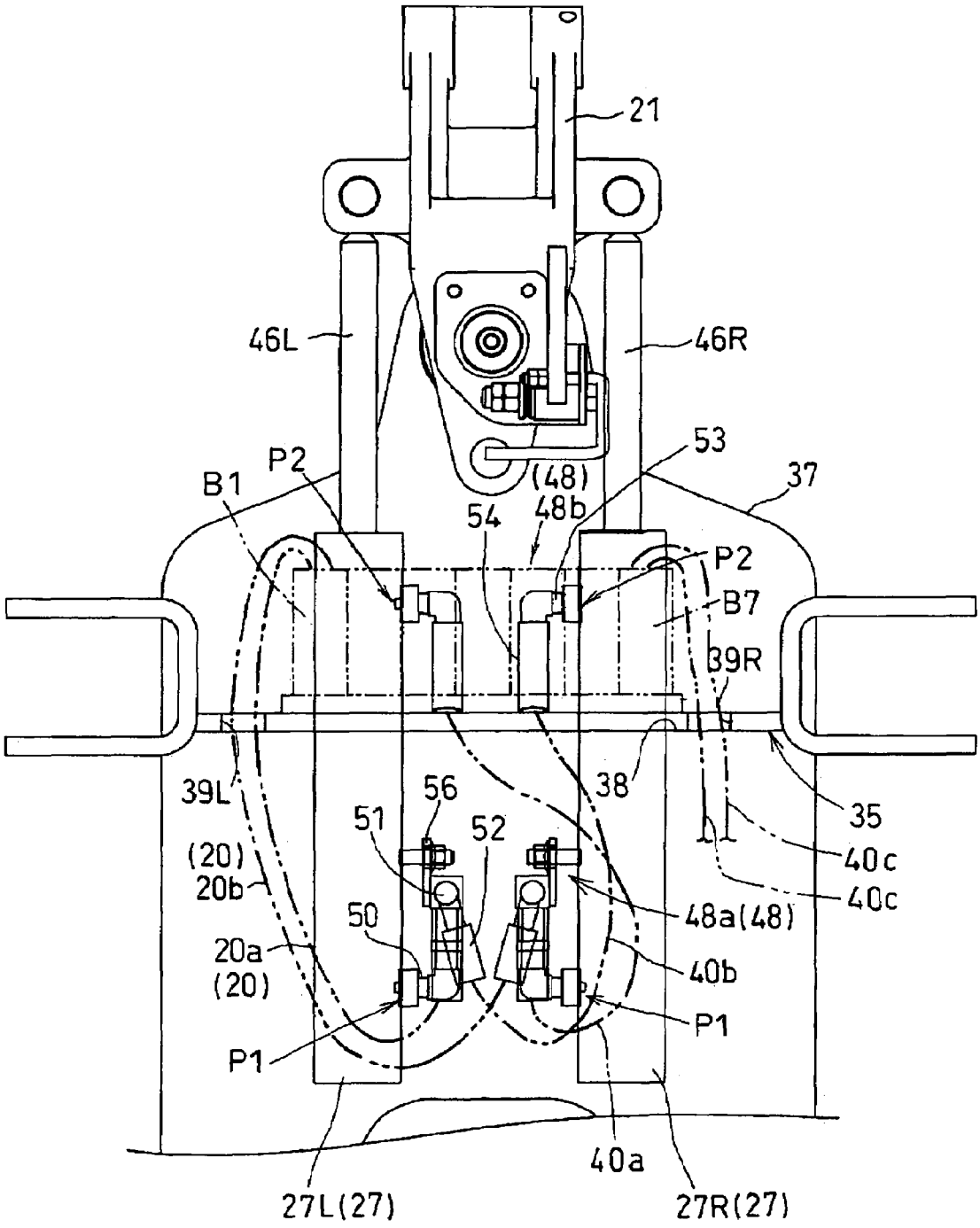
FIG. 3 is a plan view showing layout of hoses within a base frame.

As shown in FIG. 2 and FIG. 3, the base frame 14 mounts thereon a controller 25. This controller 25 includes a pair of right and left control levers 31L, 31R for controlling/operating the swing bracket 21, the boom 22, the arm 23 and the bucket 24, a pair of right and left further control levers 32L, 32R disposed between the control levers 31L, 31R and used for controlling/operating the outriggers 15, the control box 33 supporting these control levers 31L, 31R, 32L, 32R and a control valve unit C.

The control valve unit C is used for controlling the respective hydraulic cylinders for pivotally operating the swing bracket 21, the boom 22, the arm 23, the bucket 24 and the outriggers 15. This control valve unit C is disposed within the base frame 14 downwardly of the control box 33, and the control levers 31L, 31R, 32L, 32R project upwardly from the upper face of the control box 33.

The controller 25, the base frame 14, etc. together constitute a control section 13 for the backhoe 4.

The base frame 14 of the backhoe 4 comprises a pair of upper and lower flat plate-like base plates 36, 37 connected (by e.g. welding) to each other at fore-and-aft intermediate portions thereof via a partitioning wall 35. Further, at front portions of the upper and lower base plates 36, 37, a pair of right and left connected frames 17 are provided for connecting the front ends of the upper and lower base plates 36, 37 to each other.

Referring more particular to the fore-and-aft position of the partitioning wall 35, this is a position between the connected frames 17 and the control box 33 of the controller 25 and slightly forwardly of the control box 33.

The partitioning wall 35 defines, at a lower portion thereof, a first insertion hole 38 extending in the right/left direction for introducing e.g. the pair of right and left swing cylinders 27R, 27L. Further, the partitioning wall 35 defines, at right and left opposed side portions thereof, second insertion holes 39L, 39R extending vertically for introducing hydraulic hoses.

To the rear face of the partitioning wall 35, there is attached an attaching bracket 41 via fasteners 55 such as bolts and to this attaching bracket 41, the control valve unit C is attached. The control valve unit C is disposed downwardly of the control box 33 and upwardly of the swing cylinders 27R, 27L.

The control valve unit C includes a plurality of substantially rectangular valve members B arranged side by side along the right/left direction. The rear face of this control valve unit C includes various ports such as pressure fluid feed/return ports, a pump port for receiving pressure fluid from a hydraulic pump mounted on the traveling vehicle, a tank port for feeding the pressure fluid to the working fluid tank mounted on the traveling vehicle, etc.

Mark B1 denotes a swing cylinder valve for controlling the swing cylinders 27R, 27L, mark B2 denotes an arm valve for controlling the arm cylinder 28, mark B3 denotes a left outrigger valve for controlling the left outrigger 34, mark B4 denotes a right outrigger valve for controlling the right outrigger 34, mark B5 denotes a boom valve for controlling the boom cylinder, mark B6 denotes a bucket valve for controlling the bucket cylinder, mark B7 denotes a switch valve for switching over between a condition for feeding the pressure fluid of the hydraulic pump to the respective valves and a further condition for not feeding the pressure fluid to the valves, but returning it to the working fluid tank.

The swing cylinder valve B1 is disposed adjacent the second insertion hole 39L and the switch valve B7 is disposed adjacent the second insertion hole 39R.

The control lever 31L of the controller 25 is connected via a pair of rods 42 to the spools of the swing cylinder valve B1 and the arm valve B2. Hence, as each spool is operated up/down by this control lever 31L, the swing bracket 21 or the arm 23 can be operated.

The control lever 31R of the controller 25 is connected via a pair of rods 43 to the spools of the boom valve B5 and the bucket valve B6. Hence, as each spool is operated up/down by this control lever 31R, the boom 22 or the bucket 24 can be operated.

The control lever 32L of the controller 25 is connected via a pair of rods 44 to the spool of the left outrigger valve B3. Hence, as the spool is operated up/down by this control lever 32L, the left outrigger 15 can be operated.

The control lever 32R of the controller 25 is connected via a pair of rods 45 to the spool of the right outrigger valve B4. Hence, as the spool is operated up/down by this control lever 32R, the right outrigger 15 can be operated.

Figure 4:
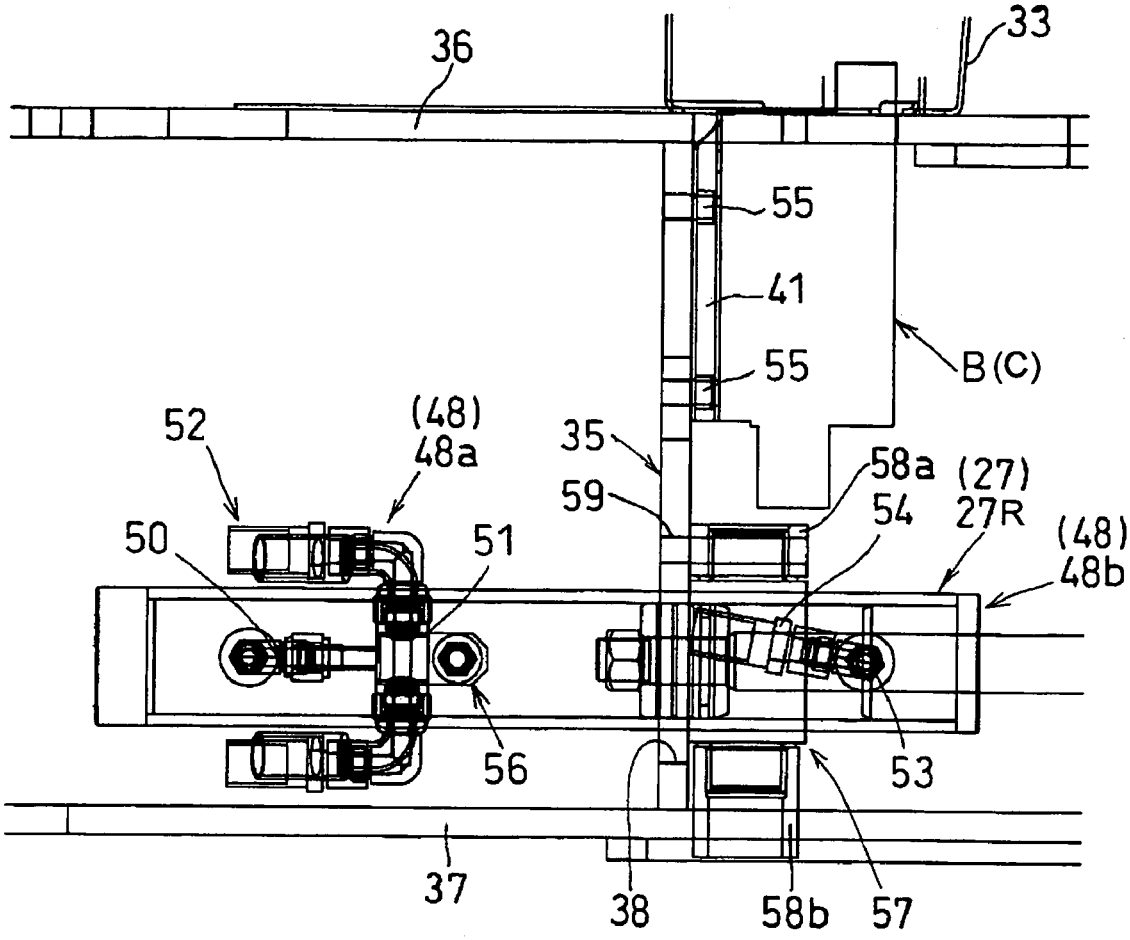
FIG. 4 is a side view in section showing the inside of the base frame.
Figure 5:
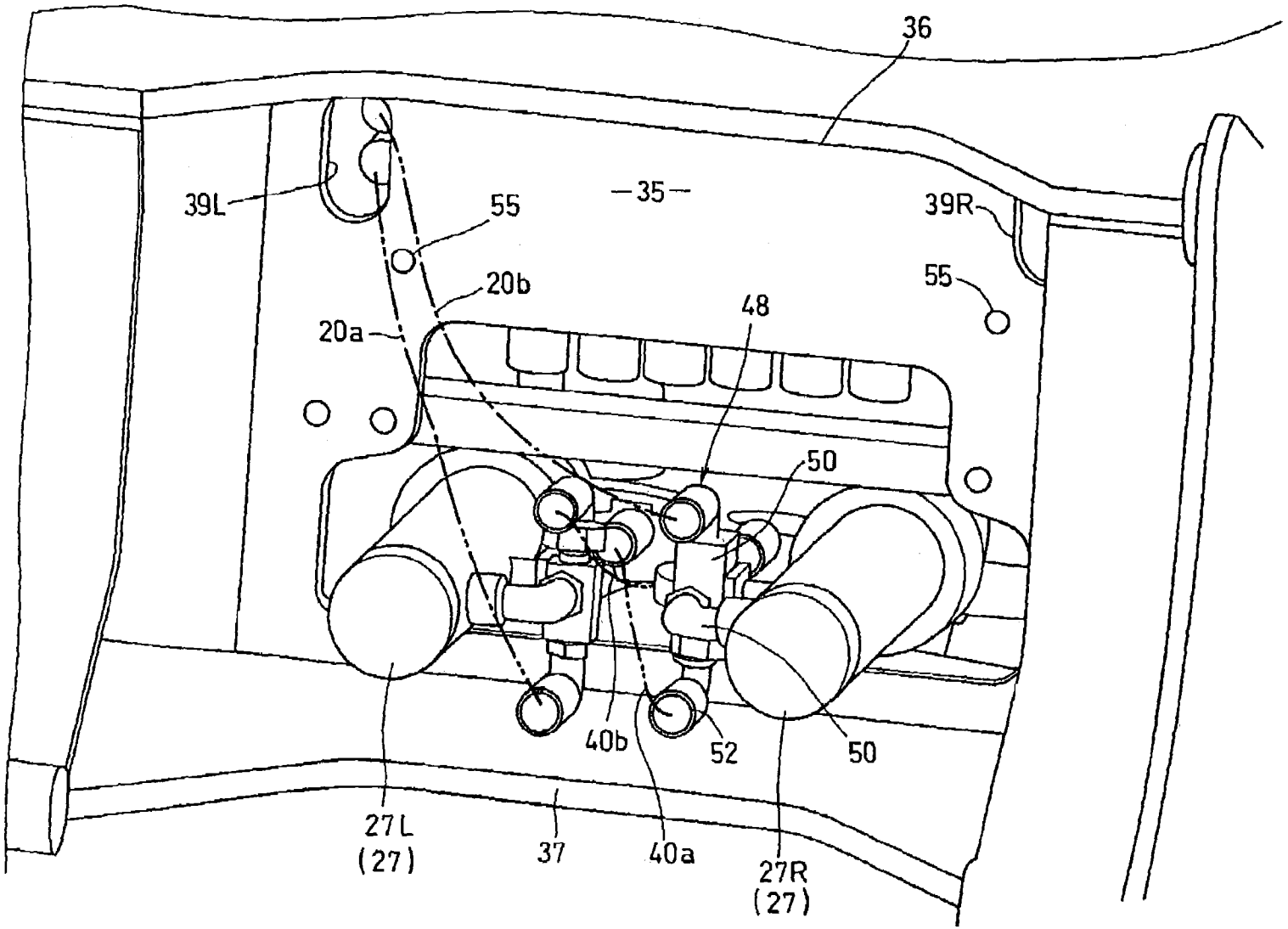
FIG. 5 is a perspective view showing the backhoe as seen from its front side.

As shown in FIGS. 2-4, the swing cylinders 27R, 27L are double-acting cylinders. The cylinder tube of each cylinder is inserted into a cylindrical member 57, and an upper projections 58*a* of a pair of projecting cylindrical portions projecting upwardly and downwardly from the cylindrical member 57 is attached to the rear face of the partitioning wall 35 via an angular bar 59 and a lower projection 58*b* thereof is attached to the lower base plate 37, whereby the respective swing cylinder 27R, 27L is mounted to the base frame 14.

To the right side of the swing bracket 21, there is connected a leading end of a cylinder rod 46R of the right swing cylinder 27R and to the left side of the swing bracket 21, there is connected a leading end of a cylinder rod 46L of the left swing cylinder 27L.

These swing cylinders 27R, 27L are extended or contracted in opposite directions relative to each other under the control of the control valve unit C, whereby the excavator 16 of the backhoe 4 can be pivoted to the right or left.

The rear portion of each swing cylinder 27R, 27L is inserted into the first insertion hole 38 defined in the partitioning wall 35, thus extending through this wall 35. A base end port P1 of each swing cylinder 27R, 27L is disposed forwardly of the partitioning wall 35 and a rod-side port P2 of each swing cylinder 27R, 27L is disposed rearwardly of the partitioning wall 35.

Referring to the pressure fluid feed/discharge ports of the two swing cylinders 27R, 27L, the base end port (corresponding to the "first port") P1 on the side of the cylinder tube and the rod-side port (corresponding to the "second port") P2 on the side of the cylinder rod of one swing cylinder are open to the other swing cylinder. To each port, there is attached a connecting member for connecting a hydraulic hose (corresponding to "first hose connecting member" and "second hose connecting member"). This connecting member 48 comprises two connecting members 48*a* on the side of the base-end port P1 and two connecting members 48*b* on the side of the rod-side port P2. These connecting members 48*a*, 48*b* are both disposed in symmetry in a plan view in the right/left direction relative to each other between the two swing cylinders 27R, 27L.

The base end ports P1 and the rod-side ports P2 of the two swing cylinders 27R, 27L are cross-connected via hydraulic hoses (specifically, two hydraulic hoses 40*a*, 40*b*). And, to the connecting member 48*a* of the base-end portion P1 of the respective swing cylinders 27R, 27L, there is connected a hydraulic hose (specifically, two hydraulic hoses 20*a*, 20*b*) 20 (corresponding to "swing hose") extending from the swing cylinder valve B1.

As shown in FIGS. 2-5, each connecting member 48*a* provided at the base-end port P1 of the swing cylinder 27R,27L includes a first projecting portion 50 connected to the swing cylinders 27R, 27L projecting toward between these swing cylinders 27R, 27L, a bifurcating portion 51 bifurcating upwardly and downwardly from the first projecting portion 50, and a first connecting portion 52 bent from bifurcated leading ends of the bifurcating portion 51 for connecting the swing hose 20 and the hydraulic hose 40.

The first projecting portion 50 is formed as an elbow joint projecting from the base-end port P1 toward between the two swing cylinders 27R, 27L and bent about 90 degrees forwardly at an intermediate portion thereof. The bifurcating portion 51 is formed as a cheese joint connected to the elbow joint and bifurcating upwardly and downwardly therefrom. The first connecting portion 52 comprises a pair of upper and lower elbow joints connected to the opposed ends of the cheese joint and having ends thereof oriented in a same direction. The bifurcating portion 51 includes a support member 48. The first connecting portion 52 of the connecting members 48*a* provided at the base end port P1 of the swing cylinder 27R,27L is oriented forwardly. At the bifurcating portion 51, there is provided a support member 56. Then, by connecting this support member 56 to the swing cylinders 27R, 27L, the rear portions of the connecting members 48*a* provided at the base-end ports P1 of the swing cylinders 27R, 27L are supported.

The connecting member 48*b* provided at the respective rod-side ports P2 of the swing cylinders 27R, 27L includes a second projecting portion 53 connected to one swing cylinder and projecting therefrom toward the other swing cylinder and a second connecting portion 54 provided at a leading end of the second projecting portion 53 for connecting the hydraulic hose 40*a*, 40*b*.

The second projecting portion 53 and the second connecting portion 54 each is formed as an elbow joint projecting from the rod-side port P2 toward the other swing cylinder and bent about 90 degrees forwardly at an intermediate portion thereof to allow connection of the hydraulic hose 40*a*/40*b* at the leading end thereof. The first connecting portion 52 and the second connecting portion 54 of the respective connecting members 48*a*, 48*b* are oriented forwardly.

The two swing hoses 20*a*, 20*b* connected to the ports of the swing cylinder valve B1 are inserted into the second insertion hole 39L to extend through the partitioning wall 35.

One swing hose 20*a* is connected to an upper portion of the first connecting portion 52 of the swing cylinder 27L and the other swing hose 20*b* is connected to a lower portion of the first connecting portion 52 of the swing cylinder 27R.

Further, the second connecting portion 54 of the swing cylinder 27L and the lower portion of the first connecting portion 52 of the swing cylinder 27R are connected via the hydraulic hose 40*a*, whereas the second connecting portion 54 of the swing cylinder 27R and the upper portion of the first connecting portion 52 of the swing cylinder 27L are connected via the hydraulic hose 40*b*. In this way, the base-end ports P1 and the rod-side ports P2 of the two swing cylinders 27R, 27L are cross-connected to each other. Accordingly, the hydraulic hoses 40*a*, 40*b* too extend to intersect each other both in their plan view and side view.

Two hydraulic hoses 40*c* connected to the ports of the switch valve B7 are inserted into the second insertion hole 39R to extend through the partitioning wall 35 and then connected respectively to the hydraulic pump and the hydraulic tank mounted on the tractor 2.

As may be understood from the foregoing description, the base frame 14 comprises the pair of upper and lower base plates 36, 37 connected at fore-and-aft mid portions thereof via the partitioning wall 35 and the control valve unit C is disposed within the base frame 14 on the rear face side of the partitioning wall 35 and downwardly of the controller 25. With these, the distance between the each swing cylinder 27R, 27L and the swing cylinder valve B1 is formed shorter and the swing hose 20 extending from the control valve unit C can be easily connected to the swing cylinders 27R, 27L. Further, the provision of the partitioning wall 35 inside the base frame 14 not only allows the control valve unit C to be disposed within this base frame 14, but also reinforces the base frame 14.

Moreover, when the connecting members 48 (48*a*, 48*b*) of the base-end port P1 and the rod-side port P2 of the swing cylinder 27L are turned 180 degrees in reverse relative to the axial direction of the swing cylinder 27, it becomes possible to connect these connecting members 48 to the other swing cylinder 27R. Namely, with the above-described construction of the connecting members 48, these connecting members 48 become attachable to both of the right and left swing cylinders 27R, 27L. Hence, these connecting members 48 can be shared by the right and left swing cylinders 27R, 27L. Consequently, the number and the assembly steps of the connecting members 48 can be restricted advantageously.

Further, as the two connecting members 48 are oriented toward between the two swing cylinders 27R, 27L, no connecting members are present on the outer sides of the two swing cylinders 27R, 27L. As a result, the right/left wise width of the base frame 14 can be short. Also, the piping to the respective connecting members 48 required for cross-connecting the swing cylinders 27R, 27L can be short.

The invention claimed is:

1. A work vehicle comprising:

a traveling vehicle;

a backhoe having a base frame detachably connected to a rear portion of the traveling vehicle and an excavator detachably attached to a rear portion of the base frame, said base frame including a pair of upper and lower base plates and a partitioning wall disposed at a fore-and-aft intermediate portion of the base plates for connecting the two base plates with each other and partitioning a space delimited between the plates relative to a fore and aft direction;

a control box mounted on the base frame;

a swing cylinder device mounted to the base frame through the partitioning wall for pivoting the excavator, the swing cylinder device including a first swing cylinder and a second swing cylinder which are juxtaposed along a right/left direction;

a first fluid feed/discharge port device to/from the first swing cylinder, the first fluid feed/discharge port device including a first port defined on the side of a cylinder tube of the first swing cylinder and a second port defined on the side of a cylinder rod of the first swing cylinder, these first and second ports opening toward the second swing cylinder;

a second fluid feed/discharge port device to/from the second swing cylinder, the second fluid feed/discharge port device including a first port defined on the side of a cylinder tube of the second swing cylinder and a second port defined on the side of a cylinder rod of the second swing cylinder, these first and second ports opening toward the second swing cylinder;

a control valve unit attached to the partitioning wall downwardly of the control box for controlling a working fluid for driving the first and second swing cylinders and the excavator;

a swing hose device extended through the partitioning wall for hydraulically connecting the control valve unit to the first and second swing cylinders;

a pair of first hose connecting member projecting from said each first port, the pair of first hose connecting members being arranged in symmetry along the right/left direction between the first and second swing cylinders; and a pair of second hose connecting members projecting from said each second port the pair of second hose connecting members being arranged in symmetry along the right/left direction between the first and second swing cylinders.

2. The work vehicle according to claim 1, further comprising:

a first hydraulic hose hydraulically connecting the first port of the first swing cylinder and the second port of the second swing cylinder; and a second hydraulic hose hydraulically connecting the first port of the second swing cylinder and the second port of the first swing cylinder;

the swing hose device including a first swing hose connected to the first port of the first swing cylinder and a second swing hose connected to the first port of the second swing cylinder; and wherein:

the first hose connecting member associated with said first swing cylinder includes a first projecting portion projecting from the first port of said first swing cylinder, a bifurcating portion bifurcating upwardly and downwardly from this first projecting portion, and a first connecting portion provided at bifurcated leading ends of the bifurcating portion, this first connecting portion including two end portions bent in a same direction to each other for connecting said first hydraulic hose and said first swing hose thereto;

the first hose connecting member associated with said second swing cylinder includes a first projecting portion projecting from the first port of said, second swing cylinder, a bifurcating portion bifurcating upwardly and downwardly from this first projecting portion, and a first connecting portion provided at bifurcated leading ends of the bifurcating portion, this first connecting portion including two end portions bent in a same direction to each other for connecting said second hydraulic hose and said second swing hose thereto;

the second hose connecting member associated with said first swing cylinder includes a second projecting portion projecting from the second port of said first swing cylinder and a second connecting portion provided at a leading end of this second projecting portion for connecting said second hydraulic hose thereto; and the second hose connecting member associated with said second swing cylinder includes a second projecting portion projecting from the second port of said second swing cylinder and a second connecting portion provided at a leading end of this second projecting portion for connecting said first hydraulic hose thereto.

* * * * *